US006160767A

United States Patent [19]

Ho

[11] Patent Number: 6,160,767

[45] Date of Patent: Dec. 12, 2000

[54] CLOCK

[75] Inventor: Wai Kwan Ho, Kowloon, The Hong Kong Special Administrative Region of the People's Republic of China

[73] Assignee: Leona Lighting Design Ltd., New Territories, The Hong Kong Special Administrative Region of the People's Republic of China

[21] Appl. No.: 09/266,737

[22] Filed: Mar. 12, 1999

[51] Int. Cl.[7] ..... G04B 19/00

[52] U.S. Cl. ..... 368/79; 368/228; 368/240; 368/227; 368/69

[58] Field of Search ..... 368/67, 240, 227, 368/228, 79

[56] References Cited

U.S. PATENT DOCUMENTS

| | | | |
|---|---|---|---|
| 3,136,210 | 6/1964 | Barrett | 88/24 |
| 4,253,170 | 2/1981 | Meisner | 368/67 |
| 4,461,581 | 7/1984 | Simon | 368/79 |
| 5,247,492 | 9/1993 | Pan | 368/79 |

*Primary Examiner*—Bernard Roskoski
*Attorney, Agent, or Firm*—Leydig, Voit & Mayer, Ltd.

[57] ABSTRACT

A clock includes a base, a clock movement held by the base and having rotatable translucent hour and minute indicators, a cover coaxially connected to the base, and a light source supported between the cover and the indicators for shining light through the indicators to form respective images around the base on a wall behind the base for displaying time. The cover includes a light diffusible extended periphery having an inner surface with an integral visual element for illumination by the light source to appear visible on an outer surface of the periphery, opposite the inner surface.

19 Claims, 3 Drawing Sheets

CLOCK

The present invention relates to a clock which incorporates a light source for displaying time by means of a shadow image.

BACKGROUND OF THE INVENTION

Clocks which incorporate a light source to display time by means of a shadow image are generally known, for example as disclosed in U.S. Pat. No. 4,253,170.

The invention seeks to provide an improved clock of this type, which is aesthetically more attractive.

SUMMARY OF THE INVENTION

According to the invention, there is provided a clock which comprises a base, a clock movement held by the base and having rotatable hour and minute indicators which are light penetrable, a cover connected by means of a connector to the base in a substantially co-axial and spaced apart manner, and a light source supported behind the cover at a position co-axially in front of the indicators for shining light through the indicators in order to form respective images around the base on an upright surface behind the base for displaying time, said cover including a light diffusable extended periphery having an inner surface on which a visual element is integrally formed for illumination by the light source to appear visible on an outer surface of the periphery opposite the inner surface.

Preferably, the visual element is integrally raised from the inner surface of the cover periphery for capturing more light than the rest of the cover periphery.

More preferably, the visual element comprises a plurality of parts and a rib joining the parts integrally together and extending around the axis of and facing the light source in order for the parts to receive via the rib more light from the light source than the rest of the cover periphery.

In a preferred construction, the cover periphery is made of a substantially transparent material for light diffusion and its outer surface is rendered matt to obscure the visual element when the light source is off.

Preferably, the visual element is in the form of a letter or character.

Preferably, the visual element is in the form of a graphic pattern.

It is preferred that the entire body of the cover is light diffusable.

In a preferred embodiment, the time indicators are substantially transparent and of different colors to form respective colored images on the upright surface.

Preferably, the time indicators are bent or folded to incline at an acute angle towards the light source.

In a specific construction, the cover includes a hollow central body holding the light source inside and having an open side providing a rim from which the periphery extends radially outwards, said rim incorporating a co-extending annular light penetrable member which is marked in order to cast a graduated image on the wail acting as a dial to facilitate time reading.

More specifically, the member is provided by a substantially transparent tape which is printed with sixty regular markings for the resulting dial image to show the seconds increments.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
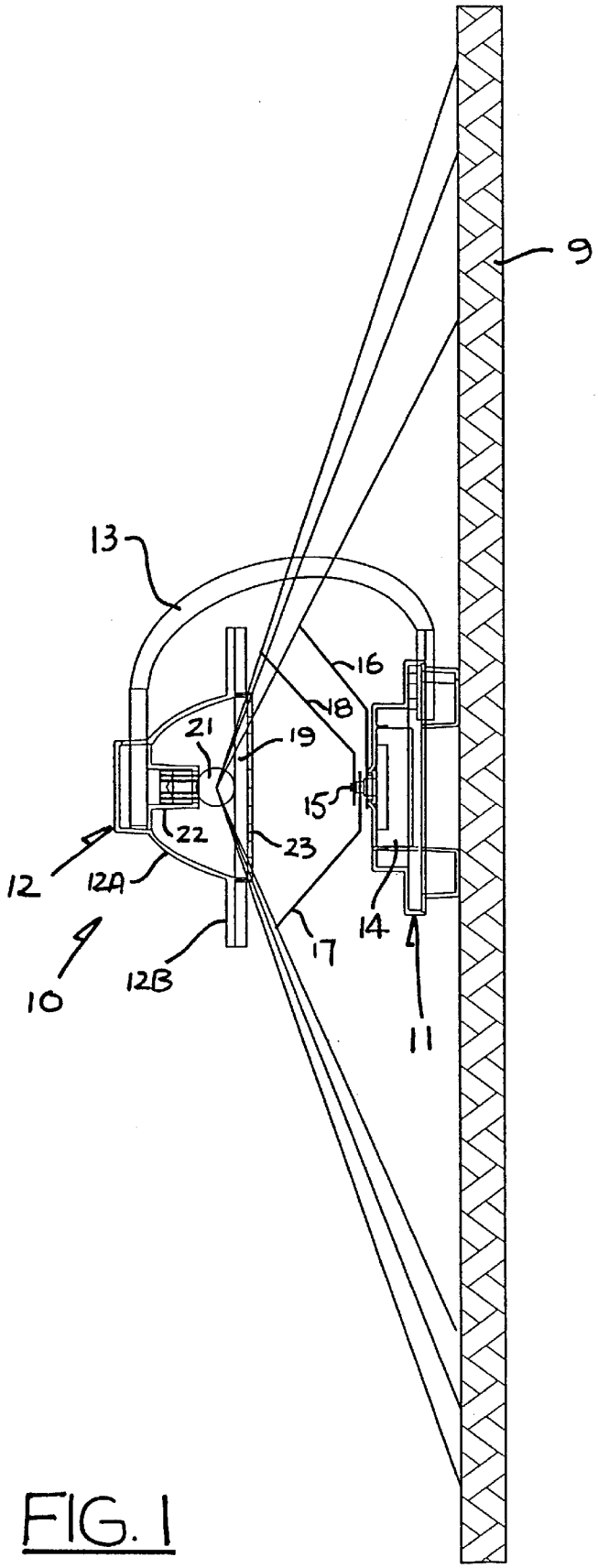
FIG. 1 is a cross-sectional side view of an embodiment of a clock in accordance with the invention, used on a wall.
Figure 2:
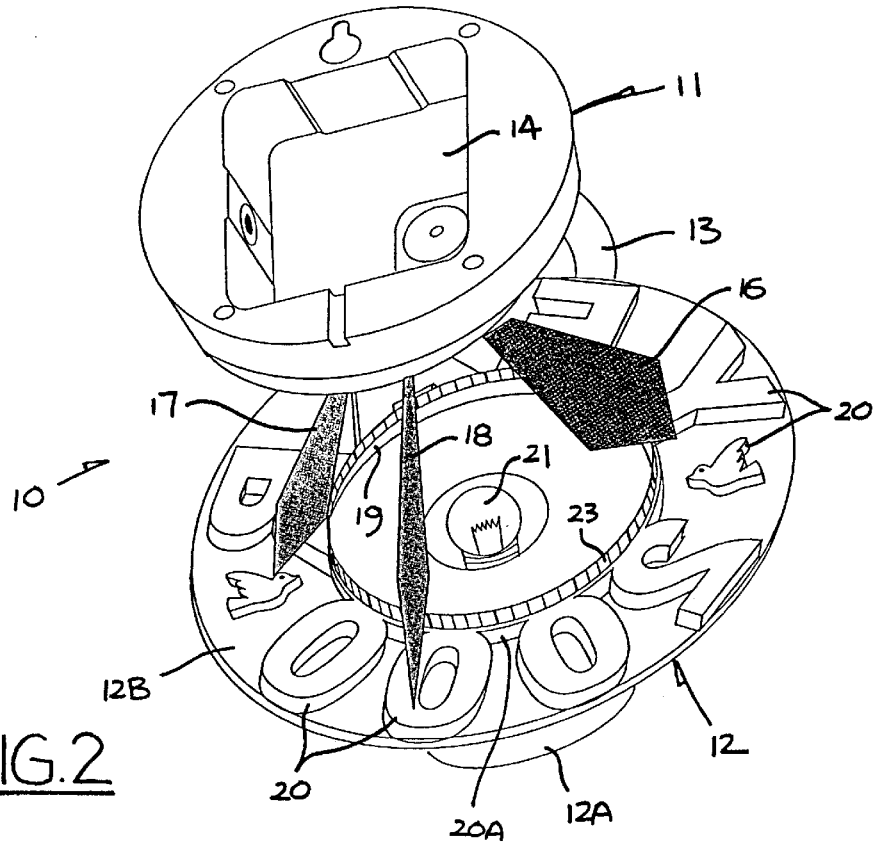
FIG. 2 is a rear perspective view of the clock of FIG. 1.
Figure 3:
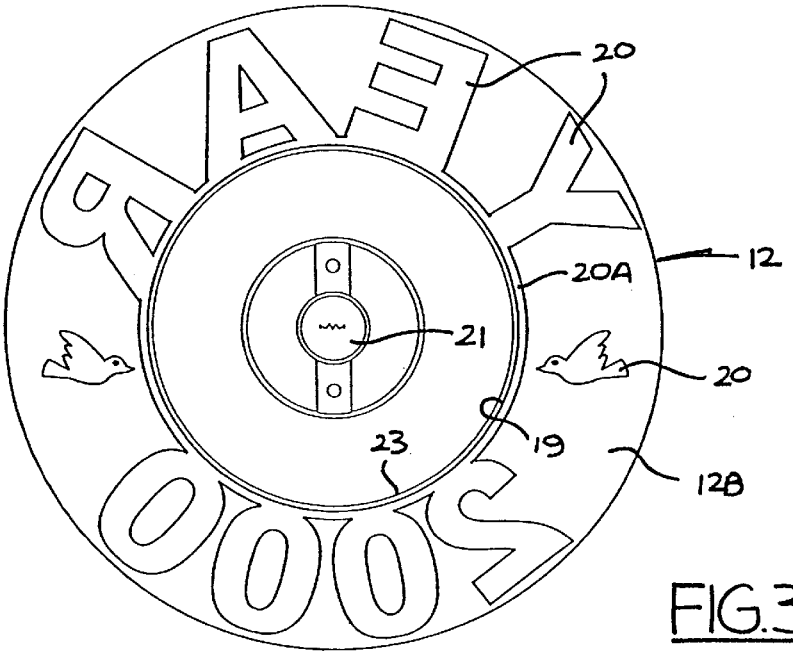
FIG. 3 is a rear elevational view of a front cover of the clock of FIG. 2.
Figure 4:
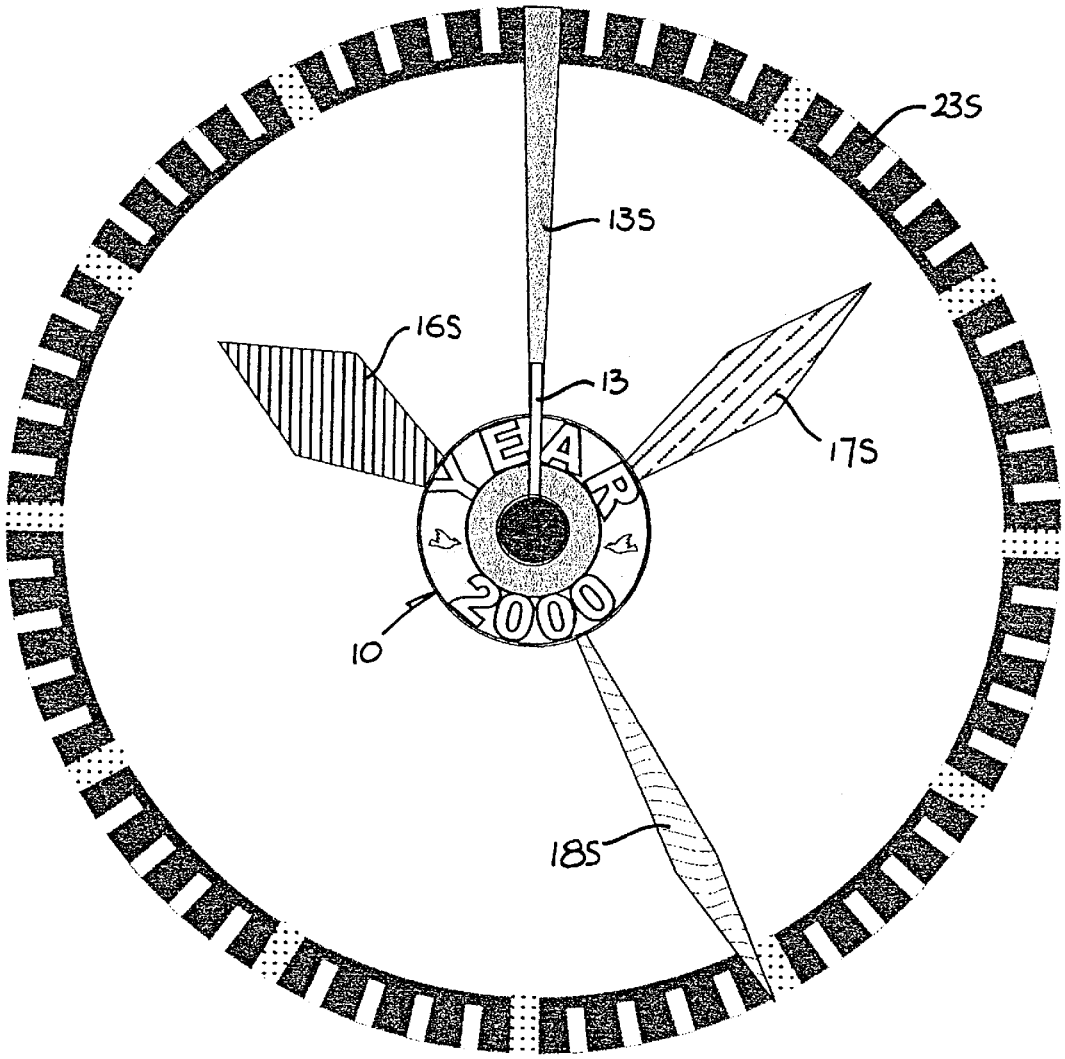
FIG. 4 is a front elevational view of the clock of FIG. 1, showing the formation of a shadow image on a wall for time indication.

Referring to the drawings, there is shown a clock 10 embodying the invention, which clock 10 has a circular rear base 11 and a circular front cover 12 connected by means of a curved arm 13 to the base 11 in a co-axial and spaced apart manner. The clock cover 12 has a bowl-like hollow central body 12A having an open side providing a rim 19 facing the clock base 11 and an annular peripheral flange 12B extending integrally around and outwards from the rim 19. The arm 13 extends from one side of the clock base 11 to the same side of the closed end of the cover body 12A, passing round the cover flange 12B. The clock 10 is to be used on a vertical wall 9, with the clock base 11 attached to the wall 9 by means of a screw or the like, such that the axis of the overall clock 10 extends perpendicularly from the wall 9.

The clock base 11 holds an internal battery-operated clock movement 14, which includes a central clock shaft 15 pointing at the clock cover 12. The shaft 15 supports hour/minute/second indicators 16, 17, and 18 for rotation to indicate time. The time indicators 16, 17, and 18 are provided by respective transparent plastic strips of different lengths and colors, such as red, blue and green, and are bent or folded to incline at an angle of about 30° to 45° relative to the clock base 11.

The clock cover 12 is made of a transparent plastic material for light diffusion, of a color which is preferably different from those of the time indicators 16, 17, and 18. A light bulb 21 is located inside and at the centre of the cover body 12A in means of a bulb holder 22. The light bulb 21 is positioned co-axially in front of and facing the clock base 11 and in alignment with the clock shaft 15. The clock base 11, the time indicators 16 to 18 and the light bulb 21 are hidden behind the clock cover 12, such that they cannot normally be seen from the front side of the overall clock 10.

On the inner surface of the cover flange 12B, a physically raised visual element 20, which may be in the form of a word, letter, character, numeral and/or graphic pattern, is integrally formed. The outer surface of the cover 12, including that of the flange 12B, is matte, such that the visual element 20 is obscured from sight from the outer side when the light bulb 21 is off.

In this particular embodiment, the visual element 20 consists of the word "YEAR", the number "2000" and two bird logos between them, as shown in the drawings. Most parts of the visual element 20, namely the letters "Y", "E", "A" and "R" and the numerals "2", "0", "0" and "0", are joined integrally together by means of an innermost annular rib 20A which is raised to the same level and extends around the axis of and facing the light bulb 21. The rib 20A coincides with the rim 19 of the cover body 12A, both having a clear transparent inner surface for the transmission of light. Immediately against the inner surface of the rim 19 or rib 20A, a co-extending transparent annular plastic tape 23 is attached. The tape 23 protrudes beyond the rim 19 or rib 20A, at where it is printed with sixty regular markings for indicating the seconds increments or positions, as described below.

For use, the clock 10 is positioned on the wall 9 in such an orientation that the connector arm 13 is at the uppermost position, corresponding to the twelve o'clock position. Based on this orientation, the time indicators 16, 17, and 18 are set to show the current time.

In operation, the light bulb 21 shines light through the protruding part of the tape 23 to form an outermost coloured ring image 23S on the wall 9 around the clock 10, which defines a graduated clock dial having marks showing the sixty seconds positions. The connector arm 13 casts a vertical straight shadow 13S on the wall 9 for explicitly showing the twelve o'clock position. More importantly, the light bulb 21 also shines light through the time indicators 16 to 18 to form respective radially-extending colored straight images 16S, 17S, and 18S within the ring image 23S for the indication of time, which can conveniently be read against the ring image 23S. The time indicators 16 to 18 are inclined towards the light bulb 21 to intersect with the light from the light bulb 21.

While the light bulb 21 is on, its light will also enter and be diffused, via the inner surface of the rim 19 and rib 20A, into the cover flange 12B including the visual element 20. As the visual element 20 is relatively thicker than the rest of the cover flange 12B, and due to the presence of the rib 20A receiving more light, the visual element 20 and in particular the word "YEAR" and number "2000" will capture more light and thus appear to be relatively brighter, thereby appearing visible (becoming prominently distinguishable) on the opposite, outer surface of the cover flange 12B.

The cover 12 acts as a light diffuser for, upon being illuminated, revealing the visual element 20, which in conjunction with the time indicating images 16S, 17S, and 18S and the dial image 23S, will render the overall clock 10 a colorfully illuminating and aesthetically attractive clock for use on a wall, particularly in a low ambient light environment.

It is envisaged that the clock 10 may not be mounted directly on the wall 9. For example, the clock 10 may instead be supported on a stand for use on a desk top close to and in front of a wall nearby, such that the time indicating images are formed on that wall. Alternatively, the clock 10 may include an upright backing wall for time indication, which may then be used anywhere.

The invention has been given by way of example only, and various other modifications of and/or alterations to the described embodiment may be made by persons skilled in the art without departing from the scope of the invention as specified in the appended claims.

What is claimed is:

1. A clock comprising:

a base, a clock movement held by the base and having rotatable translucent hour and minute indicators, a cover coaxially connected to and spaced from the base, a light source coaxial with the cover, located between the cover and the indicators, for shining light through the indicators to form respective images of the indicators around the base on a surface for displaying time, and a light diffusible ring extending peripherally from the cover, having an inner surface directed toward the clock movement and on which a visual element is integrated, and an outer surface, opposite the inner surface, the visual element becoming visible on the outer surface of the ring upon illumination of the cover by light from the light source.

2. The clock as claimed in claim 1, wherein the visual element is raised from the inner surface of the ring.

3. The clock as claimed in claim 2, wherein the visual element comprises a plurality of parts and a rib joining the parts together and extending around and facing the light source so the parts receive the light through the rib.

4. The clock as claimed in claim 1, wherein the ring is a substantially transparent material and the outer surface is matte to obscure the visual element when the light source is off.

5. The clock as claimed in claim 1, wherein the visual element is a letter or a character.

6. The clock as claimed in claim 1, wherein the visual element is in the form of a graphic pattern.

7. The clock as claimed in claim 1, wherein the entire body of the cover is light diffusable.

8. The clock as claimed in claim 1, wherein the time indicators are substantially transparent and of different colors for forming respective colored images on the vertical surface.

9. The clock as claimed in claim 1, wherein the time indicators incline at an acute angle towards the light source.

10. The clock as claimed in claim 1, wherein the cover includes a hollow central body with the light source located inside the hollow central body, the hollow central body having an open side with a rim, the rim incorporating an annular light-penetrable member marked to cast a circular graduated image on the vertical surface as a dial to facilitate time reading.

11. The clock as claimed in claim 10, wherein the member includes a substantially transparent tape printed with sixty regular division to display seconds increments.

12. The clock as claimed in claim 2, wherein the time indicators are substantially transparent and of different colors for forming respective colored images on the vertical surface.

13. The clock as claimed in claim 3, wherein the time indicators are substantially transparent and of different colors for forming respective colored images on the vertical surface.

14. The clock as claimed in claim 2, wherein the cover includes a hollow central body with the light source located inside the hollow central body, the hollow central body having an open side with a rim, the rim incorporating an annular light-penetrable member marked to cast circular a graduated image on the vertical surface as a dial to facilitate time reading.

15. The clock as claimed in claim 1, wherein the cover includes a hollow central body with the light source located inside the hollow central body, the hollow central body having an open side with a rim, the rim incorporating an annular light-penetrable member marked to cast circular a graduated image on the vertical surface as a dial to facilitate time reading.

16. The clock as claimed in claim 14, wherein the member includes a substantially transparent tape printed with sixty regular division to display seconds increments.

17. The clock as claimed in claim 15, wherein the member includes a substantially transparent tape printed with sixty regular division to display seconds increments.

18. The clock as claimed in claim 2, wherein the ring is a substantially transparent material and the outer surface is matte to obscure the visual element when the light source is off.

19. The clock as claimed in claim 3, wherein the ring is a substantially transparent material and the outer surface is matte to obscure the visual element when the light source is off.

* * * * *